US006679745B2

(12) United States Patent
Santella et al.

(10) Patent No.: US 6,679,745 B2
(45) Date of Patent: Jan. 20, 2004

(54) METHOD FOR THE MANUFACTURE OF MERCURY DISPENSER DEVICES TO BE USED IN FLUORESCENT LAMPS

(75) Inventors: Gianni Santella, Avezzano (IT); Ausonio Tuissi, Lecco (IT)

(73) Assignee: SAES Getters S.p.A., Milan (IT)

( * ) Notice: Subject to any disclaimer, the term of this patent is extended or adjusted under 35 U.S.C. 154(b) by 129 days.

(21) Appl. No.: 10/004,029

(22) Filed: Oct. 25, 2001

(65) Prior Publication Data

US 2002/0042239 A1 Apr. 11, 2002

Related U.S. Application Data

(63) Continuation of application No. PCT/IT01/00097, filed on Mar. 1, 2001.

(30) Foreign Application Priority Data

Mar. 6, 2000 (IT) ..... MI2000A0433

(51) Int. Cl.[7] ..... H01J 61/28
(52) U.S. Cl. ..... 445/9; 419/69; 419/43
(58) Field of Search ..... 445/9, 41, 45; 419/8, 69, 43, 50; 252/181.1

(56) References Cited

U.S. PATENT DOCUMENTS

| | | | | | |
|---|---|---|---|---|---|
| 3,642,340 | A | * | 2/1972 | Yamane et al. | 316/20 |
| 3,657,589 | A | | 4/1972 | Della Porta et al. | |
| 3,913,999 | A | | 10/1975 | Clarke | |
| 4,141,482 | A | * | 2/1979 | Reynolds | 419/43 |
| 4,808,136 | A | | 2/1989 | Schuster | |
| 4,820,141 | A | * | 4/1989 | Shingu et al. | 419/8 |
| 5,830,026 | A | * | 11/1998 | Schiabel et al. | 445/9 |
| 5,876,205 | A | * | 3/1999 | Schiabel et al. | 445/9 |
| 5,916,479 | A | * | 6/1999 | Schiabel et al. | 252/181.3 |
| 6,099,375 | A | * | 8/2000 | della Porta | 445/9 |

FOREIGN PATENT DOCUMENTS

| | | |
|---|---|---|
| EP | 0 568 317 A1 | 11/1993 |
| EP | 0 669 639 A1 | 8/1995 |
| EP | 0 691 670 A2 | 1/1996 |
| EP | 0 737 995 A2 | 10/1996 |
| WO | WO 98/53479 A1 | 11/1998 |

* cited by examiner

*Primary Examiner*—Dean A. Reichard
*Assistant Examiner*—Angel R. Estrada
(74) *Attorney, Agent, or Firm*—Akin Gump Strauss Hauer & Feld, L.L.P.

(57) ABSTRACT

An improved method is described for the manufacture of mercury dispenser devices to be used in fluorescent lamps, of the type wherein the dispenser material (2) is contained inside a metal tube (1), these dispensers providing a more uniform distribution of mercury, with lower fluctuations from one device to the other. This is obtained by a method according to which a tubular metal container (1') having a larger diameter than the final one (1), after the filling thereof with said dispenser material (2) is passed between at least two pairs of rollers (3, 3', 4, 4') whose axes of rotation are parallel to each other and perpendicular to the advancing direction (X–X') of the tubular container (1), until a reduction of the cross-section of the latter to the desired value is obtained, and is finally cut to the right size into the single dispenser elements

9 Claims, 1 Drawing Sheet

Figure 1:
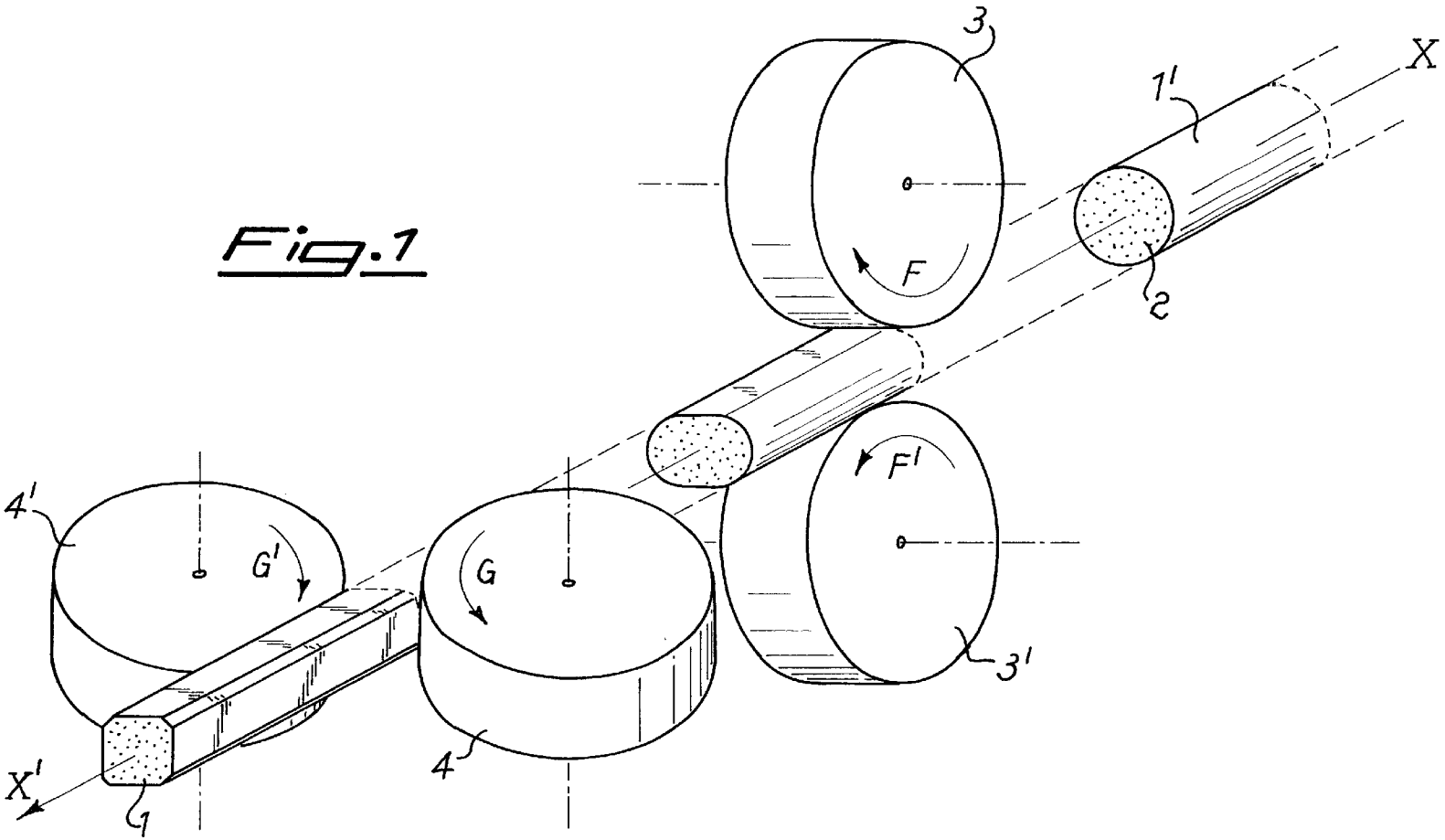

METHOD FOR THE MANUFACTURE OF MERCURY DISPENSER DEVICES TO BE USED IN FLUORESCENT LAMPS

This application is a Continuation of application PCT/IT01/00097 filed Mar. 1, 2001.

The present invention relates to dispensers of small quantities of mercury to be used in fluorescent lamps and particularly to an improved method for the manufacture thereof.

It is known that fluorescent lamps require for their working small quantities of mercury. As a consequence of technological development and of international standards being more and more careful about the use of noxious substances, such as mercury, the maximum quantity of this element used in the lamps has been recently further and further reduced, to values of about 3 mg per lamp and even less, as required by some manufacturer.

Many of the traditional mercury dosing methods are not capable of complying with these requirements, such as the volumetric dosage, since the small drops of mercury having the required weight have an extremely reduced volume, and therefore dosing them with a certain precision is almost impossible. Further, the reproducibility of the dosage would be almost null and anyway pollution problems would arise. Also the mercury introduction into the lamps in the form of pure element contained in small glass capsules does not solve the problem of dosage precision and reproducibility of such small mercury volumes.

U.S. Pat. No. 4,808,136 and European Published Patent Application No. 568 317 A1 describe the use of pellets or spheres of a porous material impregnated with mercury which is then released under heating when the lamp is closed. Also these methods require complicated operations for the loading of mercury in the pellets, and the quantity of released mercury is hardly reproducible. These methods do not solve the problem of the presence of mercury vapors in the working environment.

On the contrary, the use of mercury dispenser elements, possibly also having the function of cathodes, formed of metal tubes having a diameter of about 1 mm and a maximum length of 1 cm and filled with a suitable material that releases, when heated, mercury vapors exclusively inside the lamp wherein the dispenser element is contained, proved to be substantially satisfactory.

Since the filling of such thin tubes with powders of the mercury dispenser materials would be extremely difficult, it is known using small tubes of larger initial diameter, for example around 1 cm, and about 20 cm long, which are then drawn by exerting a traction at one end in order to pass it through a series of orifices having a section area that progressively decreases until the desired one is reached. By this operation, also the contemporaneous elongation of the tube is achieved, thus obtaining a filiform section which is then cut into many mercury dispenser elements having the desired size. For the sake of simplicity, the filiform sections will be also defined simply "wires" in the following.

By this known preparation method, the final distribution of the mercury contained in the powders inside the final "wire", and therefore of the single elements obtained from the latter by cutting, is not completely satisfying, giving place to fluctuations from one element to the other which can be quantified, by measurements of chemical analyses, in variations of at least ±12%. In this way, sufficiently homogeneous performances of the lamps wherein said mercury dispenser are mounted are not guaranteed.

Therefore, an object of the present invention is providing an improved method for manufacturing mercury dispenser elements of the above mentioned type, such that the dispenser elements so manufactured and deriving from a same initial tubular container are less different among themselves, as regards their mercury content, than those obtained with methods of the prior art, in particular the drawing methods.

The above mentioned object is achieved by means of a method having the features set forth in claim 1.

Possible other objects, advantages and features of the method according to the present invention will appear more clearly from the following detailed description with reference to the only accompanying drawing, wherein:

FIG. 1 schematically shows one embodiment of the method according to the present invention.

A metal tube 1', whose diameter is between 3 and 15 mm and wall thickness is 0,1–0,75 mm, is filled in any known way with a composition 2 suitable for dispensing mercury under heating. In general, the metal of tube 1' can be any metal having features of ductility, which under heating gives rise to reduced gas emissions and has a good electric conductivity in order to make easier the induction heating thereof; further, it will not form amalgam with mercury, in order to avoid that the vapors of this element, once released from the dispensing material 2 inside the container, are kept therein. Nickel is particularly preferred for this use.

As regards composition 2 contained inside tube 1', it can be formed of any mercury dispensing material, although the materials disclosed by U.S. Pat. No. 3,657,589 are preferred. The compound $Ti_3Hg$, produced and sold by the Applicant under the name St 505™, is particularly preferred. Composition 2 can also include a mercury dispensing material mixed with a mercury releasing promoter material, such as the copper-based alloys disclosed in the publications of European patent or application EP-669639 (Cu—Sn or Cu—Ag), EP-691670 (Cu—Si) and EP-737995 (Cu—Sn—MM, wherein MM is a mixture of elements, called mischmetal, mainly comprising cerium, lanthanum and neodymium, further to minor quantities of other Rare Earths). Alternatively, the mercury dispensing material can be mixed with a getter material so that the composition of the rare gas which forms the lamp atmosphere wherein the mercury vapors are introduced is kept constant. It is worth while noting that the mixing can be done only alternatively with the promoter material or with the getter material, and never with both together, because promoter materials carry out their function through melting and subsequent reaction with the dispensing material; a possibly present getter material would be superficially covered by the molten promoter material, so that the action thereof would be inhibited. Therefore, if the mercury dispensing material is believed to release a sufficient quantity of vapors of this element without a promoter material, the getter material can be directly mixed with the dispensing material, otherwise the latter will be directly mixed with the promoter, whereas the getter, which is anyway necessary, will have to be arranged in another lamp zone, separately from the mercury dispenser device.

As the getter material, it is possible to use alloys such as that having weight percent composition Zr 84%- Al 16%, produced and sold by the Applicant with the name St101®, the alloy having weight percent composition Zr 76.6%-Fe 23.4%, produced and sold by the Applicant with the name St 198™ or the alloy having weight percent composition Zr 70%-V 24.6%- Fe 5.6%, produced and sold by the Applicant with the name St 707™, as well as the alloy having weight percent composition Zr 80.8% - Co 14.2% - MM 5%, produced and sold by Applicant with the name St 787™.

In any case, the mixture which forms the dispenser composition 2 is in the form of a powder having particle size lower than 125 $\mu$m.

According to the present invention, the initial tube l' so filled with composition 2 is passed between at least two pairs of opposite rollers 3, 3' and 4, 4', perpendicular to each other, whose directions of rotation, schematized by arrows F, F' and G, G' in FIG. 1, are such that they push together tube l' in the advancing direction X–X' in the sense of the arrow. The distance between the two rollers of each pair is always lower than the maximum transversal dimension that the tube has immediately before coming into contact with said pair of rollers.

It is preferable that the cross-section reduction at every single rolling operation is not too large, because this could cause excessive mechanical stresses to tube 1', however it has been found that a cross-section reduction of 12% at each single rolling is preferable. For example, in the case that the cross-section reduction of a tube 1' having a diameter of about 1 cm to a "wire" having transversal size of about 1 mm is desired, 18 rollings will be necessary through two roller pairs perpendicular to each other. The 18 rollings can be carried out by using only two pairs of rollers, by passing the tube 1' through the same rollers 18 times, taking care of shortening the distance between the pair of roller before every subsequent rolling pass. Alternatively, it is possible to prepare "trains " formed of more roller pairs, such that the distance between said pairs is decreasing in the advancing direction X–X' of tube 1'; for example, by positioning a "train" of rollers formed of 12 pairs (divided into two groups of 6 pairs, perpendicular to each other), only 3 passes are necessary. Anyway, the total number of passes multiplied by the number of roller pairs is constant and is equal to the number of rollings necessary for going from the initial diameter of tube 1' to the desired final cross-section. If the relative orientation of tube 1' with respect to the axes of rotation of the roller pairs is kept constant in all the rollings, at the end a wire having a substantially square cross-section will be obtained, having rounded corners at the most. It is also possible to operate so that the axis of rotation of the roller pairs in the subsequent rollings (or of the various roller pairs in the above described "trains") is varied according to predetermined angles, for example of (360/n)°, wherein n is the total number of rollings, in order to obtain polygonal cross-sections with a higher number of sides, and even approximate the cylindrical shape at the end of the narrowing.

The last step of the method according to the present invention is the transversal cutting, at predetermined lengths, of the tube or wire 1 having the desired diameter at the end of the rolling passes, so as to obtain the mercury dispenser elements having a length of about 2–10 mm.

The above indicated advantage of having smaller fluctuations in the mercury content and therefore a better homogeneity as regards the distribution of the compound capable of dispensing mercury into the "wires" obtained according to the invention with respect to those obtained by drawing according to the method of the prior art, is apparent from the practical tests which have been carried out, as described in the following comparative example.

By starting from small cylinders 18–20 cm long and having a diameter of 1 cm, filled with a mixture formed of 61% by weight of St 505 and of 39% by weight of St 101 as above defined, some of them are transformed into "wires" of about 1 mm of diameter and 10 m long with the traditional drawing method, whereas others are brought to the same final size by using the method according to the present invention. Both the types of wire are then cut into pieces 3 mm long, then 30 pieces of wire manufactured by the traditional drawing method and 30 pieces of wire manufactured according to the method of the invention are picked up randomly. Each piece is chemically analyzed in order to determine the Hg content, with the result that the pieces obtained by cutting the "wire" manufactured according to the method of the prior art contain 0.85±0.129 mg of Hg per mm of length, that is 0.85±15.2%. On the contrary, the elements obtained by the rolling method according to the invention contain 0.85±0.061 mg of Hg per mm, that is 0.85±7.2%. Therefore, the percent fluctuation is lower than the half by the method according to the invention, and therefore the homogeneity is double, with respect to that obtained by the traditional drawing method.

What is claimed is:

1. A method for the manufacture of mercury dispenser elements to be used for fluorescent lamps, with metal envelope containing a composition (2) suitable for releasing mercury, comprising the steps of:

a) filling with said composition (2) a tubular metal envelope (1') having a diameter larger than that required for the single final mercury dispensers;

b) passing said tubular envelope (1') between at least two pairs (3, 3'; 4, 4') of opposed rollers, having the axes perpendicular to the advancing direction (X–X') of the tubular envelope (1') for a number of rolling passes sufficient for obtaining a filiform section (1) having the desired transversal size; and c) cutting said section (1) into single pieces of about 0.2–1 cm which form the finished dispensers.

2. A method according to claim 1, wherein at each rolling pass the cross-section of the envelope is reduced of about 12%.

3. A method according to claim 1 or 2, wherein the material of said envelope (1, 1') is a ductile metal, having a good electrical conductivity, releasing no gases under heating and forming no amalgam with mercury.

4. A method according to claim 3, wherein said metal is nickel and the initial thickness of the tubular envelope (1') is between 0,1 and 0,75 mm.

5. A method according to claim 3, wherein said metal is nickel and the initial diameter of the tubular envelope (1') is between 3 and 15 mm.

6. A method according to claim 1, wherein said composition (2) is formed of a mixture of mercury dispensing material with a mercury release promoter material.

7. A method according to claim 1, wherein said composition (2) is formed of a mixture of a mercury dispensing material with a getter material.

8. A method according to claim 6 or 7, wherein said mixture is introduced into the tubular envelope (1') in the form of a powder having particle size not higher than 125 $\mu$m.

9. A method according to claim 1, wherein at each rolling the axis of rotation of the roller pair is varied by an angle of (360/n)' with respect to the preceding rolling, wherein n is the total number of rollings.

* * * * *